United States Patent [19]

Blind

[11] 4,009,868

[45] Mar. 1, 1977

[54] FRONT-DISCHARGE TRANSIT CONCRETE MIXER

[75] Inventor: James P. Blind, St. Louis County, Mo.

[73] Assignee: Panaview Co., Valley Park, Mo.

[22] Filed: Mar. 5, 1976

[21] Appl. No.: 664,295

[52] U.S. Cl. ..... 259/172; 296/28 C; 259/161; 259/177 R

[51] Int. Cl.[2] ..... B28C 7/16; B28C 5/18

[58] Field of Search ..... 296/28 C; 259/161, 169, 259/170–177

[56] References Cited

UNITED STATES PATENTS

| | | | |
|---|---|---|---|
| 2,859,949 | 11/1958 | Willard | 259/177 R |
| 3,019,002 | 1/1962 | Prichard | 259/169 |
| 3,334,872 | 8/1967 | Hansen et al. | 259/172 |
| 3,367,636 | 2/1968 | Duecy | 259/175 |
| 3,633,879 | 1/1972 | Prichard | 259/172 |
| 3,929,321 | 12/1975 | Sims | 259/175 |

*Primary Examiner*—William Price
*Assistant Examiner*—Douglas B. Farrow

[57] ABSTRACT

A front-discharge transit concrete mixer utilizes a cab-around-engine chassis which is standard except for the cab roof, over which a mixer barrel extends. The cab roof over the engine enclosure has a fore-and-aft channel to accommodate the barrel extension. Although the channel is cut away deeply at the rear, to permit the cab to be tilted forward, no seating space is lost. A discharge funnel which receives concrete mix from the barrel extension is mounted forward and above the cab roof by structure which includes girders flanking the barrel extension which sweep aft, above the cabin and then downward to mounts off of the cab. In the preferred embodiment the forward ends of the girders are secured to forward structure, on which the charging and discharge apparatus is mounted, such forward structure including columns mounted at each side of the front of the cab, between which the cab may tilt forward.

14 Claims, 2 Drawing Figures

FRONT-DISCHARGE TRANSIT CONCRETE MIXER

BACKGROUND OF THE INVENTION

The present invention relates to transit concrete mixers of the type having a mixer barrel whose axis is directed forward and slantingly upward, with the barrel extension projecting over and forwardly beyond the cab. Vanes within the barrel extension are so convoluted as to deliver the concrete forward and upward through the barrel extension when the barrel is rotated in one sense, and retain and continuously agitate the concrete mix therein when the barrel is rotated in the opposite sense.

Transit mixers which discharge forwardly are not new. One type in use is shown in U.S. Pat. No. 3,334,872, dated Aug. 8, 1967; this mixer requires a special chassis with the engine in the rear. In the constructions proposed in two earlier U.S. Pat. Nos. 2,859,949 and 3,019,002, the engines are loctated immediately behind the truck cabs. All such unconventional chassis are undesirable because of high initial cost and delays and repair maintenance.

SUMMARY OF THE INVENTION

The principal purpose of the present invention is to provide a forward-discharging transit concrete mixer which uses a standard tilt-cab-around-engine chassis. In this type of chassis an engine enclosure is located within the cab sideward of the driver's seat, leaving seating space at the opposite side of the cab for one passenger. A further purpose is to accommodate on such standard chassis a conventional mixer barrel with a forward-projecting extension barrel, and to provide changes in the cab roof to accommodate the lower part of the discharge barrel extension in the space above the engine enclosure. A still further purpose is to provide discharge apparatus and structure which permits the cab to swing forward through its full normal tilt angle, for access to the engine, on merely detaching the discharge chute; and which permits a lesser degree of forward tilt for routine service operations. An alternate purpose is to permit lowering of discharge apparatus forward of the cab to ground level as for painting or other service operations, thereby clearing the cab for tilting.

These purposes and others which will become apparent from this specification are achieved in the manner set forth hereafter, which may be summarized generally and without limitation as follows:

On a standard cab-around-engine truck chassis, a concrete mixer barrel, with a forwardly projecting extension, is mounted on an axis which extends slantingly forward and up. The cab roof and its rear wall are cut away to provide a channel over the engine enclosure, to accommodate the extension of the mixer barrel without loss of seating room, the channel increasing in depth toward the rear sufficiently to pass the barrel extension when the cab is tilted forward. Conventional apparatus for charging the mixer barrel through its extension and receiving and placing the concrete discharged from it are supported slightly forward of the cab. Structure outboard of the barrel extension, which provides at least part of the support for the charging and discharge apparatus, includes a pair of longitudinal girders, extending aft from the discharge apparatus flanking the barrel extension and then slopingly downward, to mounts rearward of the cab; the bends in these girders provide clearance to the arcuate swing of the top aft portions of the cab outboard of the roof channel.

In the preferred embodiment, the structure includes also forward structure, comprising a pair of columns outboard of the forward part of the cab, with structural members extending inward to the girders and discharge apparatus at a clearance level above the cab. When the discharge chute is removed, the cab may swing through the full standard tilt angle, normally 60°. However, even without removing the discharge chute the cab may be tilted forward about 25° to obtain limited access to the engine for routine servicing operations.

Further, the forward structure bearing the charging and discharge apparatus, may be readily released from the girders and lowered to ground level for servicing.

DESCRIPTION OF THE PREFERRED EMBODIMENT

Figure 1:
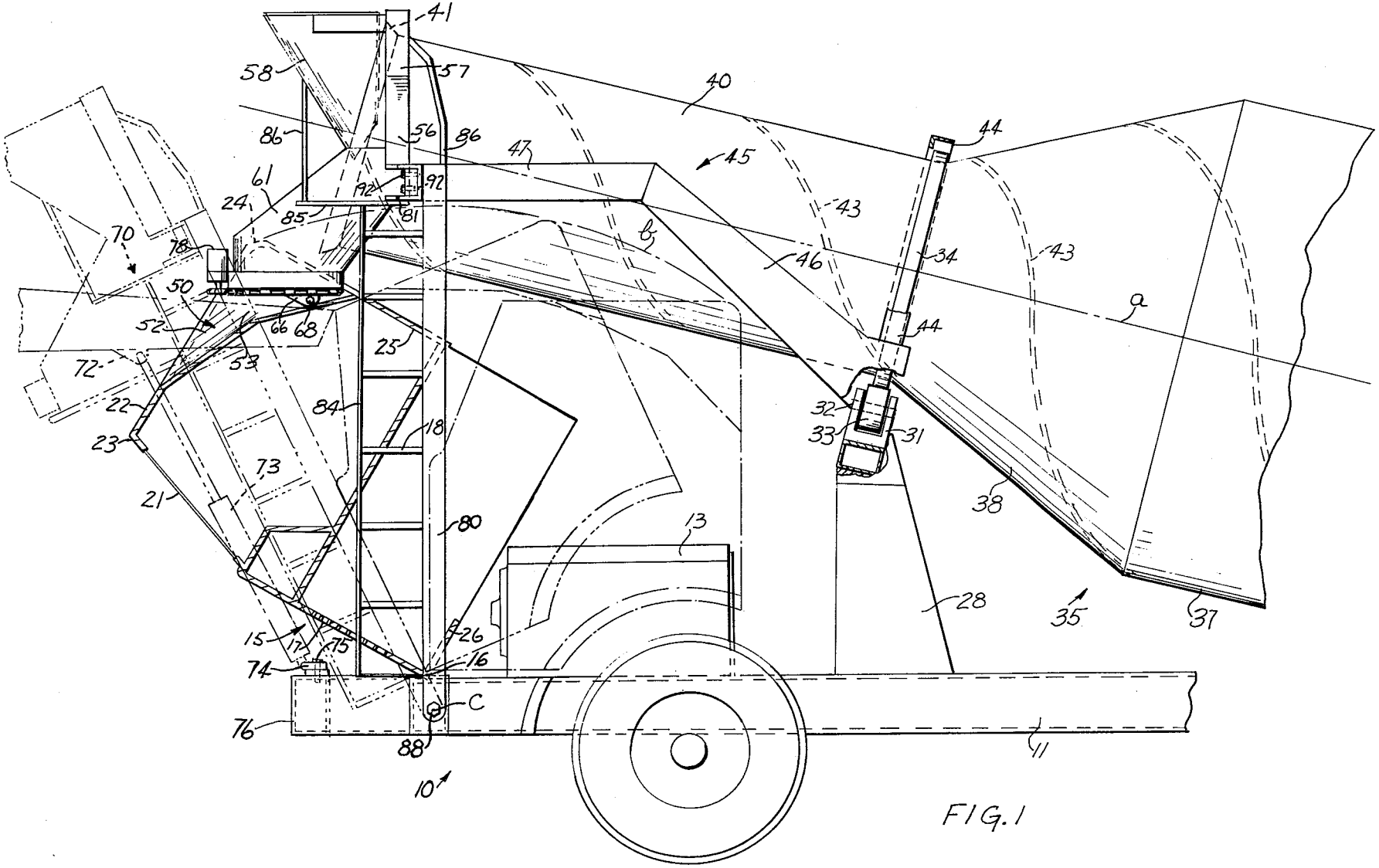
FIG. 1 is a partly schematic elevational view of the forward end of a transit concrete mixer truck embodying the present invention, with the cab tilted fully forward and shown in vertical section, the discharge chute being removed. The single dotted phantom lines show the position of the cab when erect; the double dotted lines show its position when tilted forward close to the discharge chute. The triple dotted phantom lines show the forward structure bearing the charging and discharge apparatus tilted forward.
Figure 2:
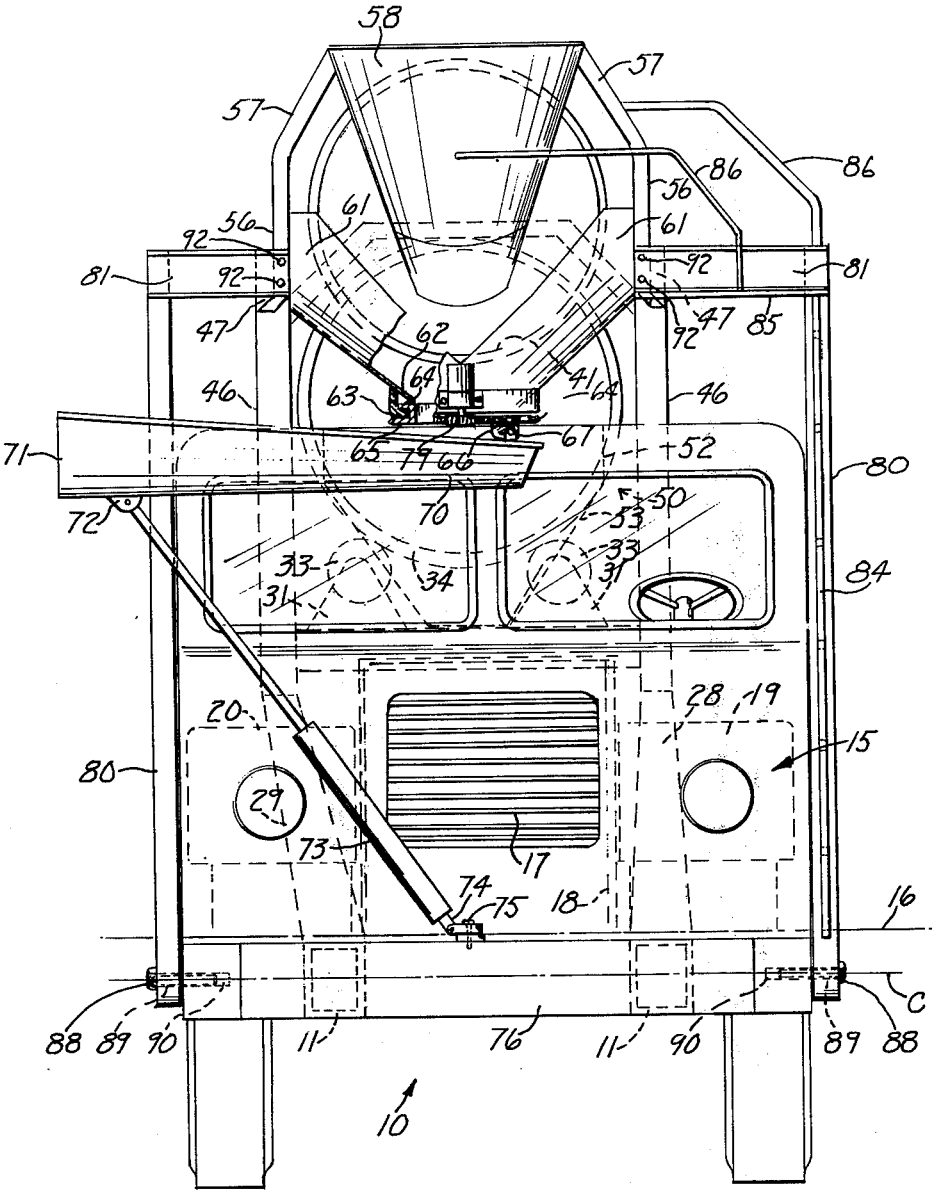
FIG. 2 is a front view, with the cab erect, showing the discharge chute turned sideward.

In the present invention a conventional tiltable cab-around-engine truck chassis generally designated 10 is used. FIG. 1 shows such a chassis 10 schematically. A pair of heavy longitudinal beams 11, spaced inwardly from the wheels 12 at equal distances from the central fore-and-aft plane of the chassis, mount an engine 13 having a conventional drive, now shown, to the rear wheels. A tilt cab generally designated 15 is mounted for forward tilting along a transverse axis 16 by conventional pivot-tilt means, not shown. The front of the cab 15, shown in solid lines is penetrated by a radiator grill 17 opening into a walled engine enclosure 18 which, when the cab is in erect position, fits over the engine 13. The enclosure 18 occupies a central space at the lower part of the cab 15 which is slightly offset away from the driver's position, as seen in FIG. 2, leaving a driver's seat 19 somewhat wider than the passenger seat 20 at the opposite side of the engine enclosure 18. The cab 15 has, above the grill 17, a windshield 21, a top wall 22 commencing with a forward intersection 23 above the windshield and having a top-to-rear wall intersection 24, a rear wall 25 which may have windows behind the driver's and passenger's positions 19, 20, and a floor 26. All this being conventional, it is illustrated only schematically.

Arising from the main beams 11 of the chassis 10 aft of the engine 13 and cab 15 are left and right pylon-like structural girder mounts 28, 29 which are joined by a heavy cross brace 30. Mounted on top of the cross brace 30 inwardly of the girder mounts 28, 29 are left and right roller brackets 31 having forward-and-upward tilted pins 32 on which are mounted rollers 33 which support the forward barrel ring 34 of a mixer barrel to be described. As seen in FIG. 2, the structure described is not symmetrical about the fore and aft center line of the chassis; instead it is displaced sideward away from the driver's position 19.

The mixer barrel, generally designated 35, is conventional. Its aft end is conventionally equipped with a heavy ring having projecting gear teeth, riding on a cradle of rollers and rotated by a hydraulic motor, not shown. Except for mounting the barrel to extend slanting forward, rather than aft, the structure and rotation mechanism are conventional. The longitudinal axis *a* of the barrel 35, about which it rotates, is directed forward and slantingly upward. As is conventional, the barrel has a main cylindrical portion 37 and a conical portion 38 tapering to a smaller diameter at the forward ring 34. Forwardly of the ring 34 is a cylindrical barrel extension 40 projecting forward beyond the cab 15 to a forward end lip 41. Extending through the barrel 35 and its extension 40 are internal convoluted mixer vanes 43. The direction of their convolution is such as to deliver concrete mix from the barrel outward through the barrel extension 40 and over its lip 41 when rotated counter-clockwise as viewed looking forward (that is, clockwise in FIG. 2). Hence, when rotated in the opposite sense (that is, counter-clockwise in FIG. 2), the concrete will be retained in the bottom of the mixer barrel and shifted slightly to the right, toward the driver's side. When the transit mixer is being driven on a highway, the barrel 35 will be maintained in rotation in this sense for continued agitation of the concrete mix. While so rotating, much of the concrete mix is shifted toward the driver's position; and the shift of its weight compensates for the offset at which the barrel 35 is mounted.

The roller bracket 31 seen in FIG. 1 is positioned inwardly of the left girder mounted 28. A protective arch 44 whose lower ends are welded onto the top ends of the left and right girder mounts 28, 29 spans the intersection of the barrel 35 with the barrel extension 40, protecting the barrel ring 34.

Also welded onto these upper ends of the girder mounts 28, 29 are the lower aft ends of longitudinal left and right bent girders, generally designated 45, which extend slantingly upward and then forwardly to serve as support structure for discharge apparatus hereafter described. In the preferred embodiment shown in FIG. 1, each bent girder 45 is a box beam constructed of two portions, a larger tapering, aft-sloping portion 46 whose lower aft end is welded onto the pylon-like girder mounts 28, and a forward, nearly horizontal portion 47 which joins the sloping aft portion 46 at an intersection spacedly above the roof of the cab 15. The aft and then downward sweep of the girders 45 provides clearance for the cab 15 when tilted forward, as later described and as shown by the dashed line *b* in FIG. 1.

In the elevational view, FIG. 1, the arc *b* overlaps much of the barrel extension 40. In the present invention advantage is taken of the fact that there is a substantial coincidence, relative to the longitudinal centerline, in the positions of the barrel extension 40 and of the engine enclosure 18. The barrel extension 40 occupies space directly over the engine enclosure 18. To cut away the cab 15 in this area does not take away from the seat space at the driver's seat 19 or passenger's seat 20, nor detract in substance from the useful space within the cab. Thus, a channel, generally designated 50, which may be formed of molded glass fiber material, is inserted in the cab roof 22 and the rear wall 25, as best seen in the forward-tilted position of the cab shown in FIG. 1. The channel portion 50 accommodates the lower part of the barrel extension 40 not only in driving position but also throughout the range of tilting movement of the cab 15. For ease of fabrication, compound curvatures are to be avoided; hence the channel has two downward-bent parts which dip to straight center lines, as follows: a forward part 52 which commences spacedly aft of the forward intersection 23 of the roof and extends aft and downward, with its centerline at an angle slightly greater than that of the barrel extension 40; and an aft portion 53 whose centerline slopes at a greater angle, cutting down deeply into the cab space above the aft part of the engine enclosure 18. This deep downward cut of the aft channel portion 53 permits the cab roof 22 to pass the underside of the barrel extension 40 and then beneath certain fixed-position discharge apparatus, to be described, while the roof-to-rear wall intersections 24 outboard of the barrel extension 40 are passing in the arc *b* beneath the girders 45.

The forward ends of the forward box beams 47 are connected, as later described, to forward structure including a pair of vertical beams 56 whose upper ends 57 turn inwardly. The beams 56 mount the apparatus necessary to charge the mixer barrel 35 with concrete and to place the discharge of concrete therefrom. Included in the apparatus so mounted in a charging funnel 58 suspended from the inward projecting ends 57, whose lower end drops concrete into the slanting mouth of the barrel extension 40. Beneath the charging funnel 58, the vertical beams 56 support the left and right inward-leading discharge funnel portions 61, which extend below the lip 41 of the barrel extension 40 in position to collect concrete mix as it is delivered over the lip 41. The inward-leading funnel portions 61 merge at a bottom center discharge funnel outlet portion 62, which discharges mix into a rotatable chute, hereafter described. Mechanism therefor may include an inward-extending flange 63 around the base of the funnel 62, which supports the bearing flange 64 of a sprocket ring 65, which surrounds the funnel outlet 62. Depending from the ring 65 are a pair of chute pivot lugs or mounts 66 whose bores 67 have a common horizontal transverse axis, to receive chute mounting bolts 68. In these are mounted the upper end of a conventional tiltable discharge chute, generally designated 70, which may have conventional supplemental folding chute portions, not shown, attached to its outer end 71. Spaced inward from its outer end 71 along its underside is a lug 72 which mounts the upper end of an extensible hydraulic actuator 73 whose lower end has a pivoted mounting lug 74 which may be rotated about a vertical pivot pin 75 mounted on forward transverse beam structure 76 which extends across the front end of the chassis, supported by its longitudinal beams 11. The azimuthal angle of the chute 70 is controlled by a hydraulic motor 78 mounted forward of the discharge chute 70 and having a chain and sprocket 79 which drives the ring 65.

Preferably the forward structure on which such apparatus is mounted includes a pair of vertical columns 80 mounted, as later described, onto the outer ends of the forward transverse beam 76 laterally outward of the cab 15 and adjacent to its forward end, the upper end of each column 80 being joined to the adjacent vertical beam 56 by an inwardly extending channel beam 81.

The inner ends of these are releasably secured to the forward ends of the bent girder 45.

Another function of the columns 80 is to support provisions for access to the apparatus. Thus the column 80 at the side seen in FIG. 1 serves as one side of a ladder 84 leading to an access platform 85 which extends at about the level of the beams 81 alongside the discharge funnel 58. Upper hand rails 86 may extend from the upper end of this column 80 above the platform 85 to the charging funnel 58.

Since the columns 80 are spaced sideward outwardly of the cab 15, it may be tilted forward between them from the single-dotted to the double-dotted phantom line portion through an angle of approximately 25° without removing the discharge chute 70. When retained in this partly tilted position by a stop, not shown, the engine 13 is sufficiently accessible for normal service operations. In this position the forward intersection 23 of the cab roof 22 is immediately aft of the end of the discharge chute 70, while the rear wall intersections 24 outboard of center have moved along the arc *b* upwardly close to the forward portion 47 of the girder 45, and the aft channel portion 53 of the cab roof 22 fits closely beneath the mixer barrel extension 40. Thus without dismantling any part of the apparatus, tilting of the cab 15 to the 25° position permits routine servicing. For engine repairs, however, full access may be necessary. One means of access is to remove the chute mounting bolts 68 and withdraw the chute 70 sufficiently to permit tilt of the cab 15 to the solid line position shown in FIG. 1. While 45° tilt would suffice, the degree of tilt normally provided is approximately 60°. As seen in FIG. 1, the channel portion 50 of the cab roof 22 accommodates the lowermost portions of the fixed discharge apparatus including the pivot lugs 66, so that the cab 15 may pass beneath them as it tilts forward between the columns 80.

The girders 45 which flank the barrel extension 40 are referred to as aft structure, to distinguish them from forward structure, which comprises the columns 80, the inward extending beams 81 and the vertical beams 56, on which the charging funnel 58 and the discharge funnel 61, ring 65 and discharge chute 70 are supported. For certain uses, rather than removing the chute 70 as heretofore described to permit full forward tilt of the cab 15 between the columns 80, it may be preferable to move out of the way this entire forward structure and the apparatus which it supports. This apparatus may require as frequent access as does servicing the engine, and some necessary operations, such as repainting the funnels and chutes, can most easily be performed at ground level.

For such ground level servicing, I prefer to provide heavy horizontal hinge pins 88 which extend through transverse bores 89 in the lower ends of the columns 80. The hinge pins 88 are threaded at their inner ends to screw into threaded sockets 90 at the ends of the transverse beam 76. The sockets 90 are aligned with each other on a lateral axis *c* below the axis 16 on which the cab 15 tilts.

Bolts 92, through the inner ends of the beams 81 and secured in tapped holes in the forward ends of the girders 45, provide releasable attachment between the girders 45 and the forward structure. When the bolts 92 are removed, this entire forward structure and all the charging and discharging apparatus mounted thereon may tilt forward and down, around the axis *c*, as shown fragmentarily in the triple dotted phantom lines of FIG. 1, all the way to the ground. This clears the forward side of the cab 15, to be tilted forward under the girders 45 and the barrel extension 40.

An added advantage which flows from this alternative construction is that the channel 50 in the cab roof may be tailored solely to pass the barrel extension 40, regardless of the width and height of the discharge funnel 61 and the chute pivot lugs 66 which extend downwardly from it.

Instead of pivoting the lower ends of the columns 80 as described, these lower ends may be held by other means to permit movement of the forward structure and apparatus mounted thereon out of their positions relative to the barrel extension of the cab 15. Thus vertical socket means may be provided at the ends of the transverse beam 76, to which are bolted the lower ends of the columns 80. With such vertical socket mounting, a simple hoist may be used to remove the forward structure and the apparatus mounted thereon after the bolts 92 have been removed.

Where the lower ends of the forward structure are hinged, fitted in sockets, or otherwise arranged to permit the forward structure with the charging and discharge apparatus mounted thereto to be moved out of their positions relative to the barrel extension and cab, such provisions will relieve any problem of the cab clearing low apparatus. With such provisions, forward structure will suffice if it is releasably securable to the aft structure and pivoted-mounted to the forward transverse beam 76 of the chassis, and which supports the apparatus in proper position and is movable forward out of the path of tilt of the cab 15. In the claims which follow it has been necessary to utilize words corresponding to the description of the preferred embodiment; but these are intended to imply their full range of equivalents. For example, the defined columns and inwardly extending beams comprehend an arched structure, including columns whose upper ends are bent inward and structurally joined by the supported apparatus itself. Also the aft structure, though defined as "longitudinal girders flanking the barrel extension," comprehends truss structure, which may extend forward, inward and upward from the chassis beams to a juncture above the forward end of the barrel extension, at which the forward structure may be releasably secured.

With these alternatives, and with other modifications which will suggest themselves, the present invention makes possible the use of a cab-around-engine chassis 40 for a forward discharge transit mixer, the chassis being standard except for the modification of the cab roof 22 above the engine enclosure 18. The end result is to provide substantial advantages in reduction of initial cost of forward discharge transit mixers as well as the servicing advantages described.

Further alterations and modifications of structure, to adapt the present invention to other detailed uses, will suggest themselves to persons familiar with transit concrete mixers. All such obvious modifications are to be deemed comprehended by this disclosure.

I claim:

1. A front discharging transit concrete mixer comprising a tiltable cab-around-engine truck chassis of the type having means to permit forward tilt of the cab through an angle of substantially 45° or more about a lower forward transverse tilt axis and having within the cab an engine enclosure and a driver's position at one side thereof, a rotatable mixer barrel mounted on said chassis and having an axis of rotation directed forward and slantingly upward and having a barrel extension therealong projecting forward beyond the cab, said barrel and barrel extension having internal vanes so convoluted as to deliver concrete mix therefrom when rotated in one sense and to retain and continuously agitate it therein when rotated in the opposite sense, fixed discharge apparatus at the forward end of said barrel extension supported forwardly of the cab and above the level thereof, and having support structure including columns laterally outward of the cab adjacent to its forward end, said fixed discharge apparatus including a discharge funnel in position to receive concrete delivered by said barrel extension and a horizontal ring bearing positioned about the lower end of said discharge funnel, and a removable discharge chute the upper end of which is supported rotatably by and beneath said ring bearing in position to receive concrete from said discharge funnel, the cab roof and rear wall having a channel portion under the barrel extension and over the engine enclosure, whereby to accommodate said barrel extension, said channel portion increasing in depth toward the rear sufficiently to pass said barrel extension when the cab is tilted forward, whereby, on removal of said removable discharge chute from its support by said ring bearing, the cab may be tilted fully forward beneath the fixed discharge apparatus and between the columns for access to the engine.

2. A transit concrete mixer as defined in claim 1, wherein said support structure further includes a pair of longitudinal girders extending from said fixed discharge apparatus rearward spacedly above the forward part of the cab and flanking the barrel extension and descending slopingly downward, past the intersections of the cab roof and rear wall outboard of the channel portion, to girder mounts rearward of the cab, the portions of said girders forward of said roof-wall intersections being at such height as to provide clearance for the arcuate swing of said intersections about the tilt axis when the cab is tilted forward.

3. A transit concrete mixer as defined in claim 1, wherein the engine enclosure is offset from center away from the driver's position, and in which the axis of the mixer barrel and barrel extension is similarly offset, and in which the direction of convolution of the vanes for such continued agitation is in such sense as to displace concrete within the mixer to the opposite side of center, whereby such displacement substantially balances the offset of the barrel and barrel extension and permits greater room within the cab at the driver's position.

4. A transit concrete mixer as defined in claim 1, together with power drive means supported by said structure to rotate said ring bearing, whereby to control the azimuthal position of said removable discharge chute.

5. A transit concrete mixer as defined in claim 1, in which the ring bearing includes downward-extending pivot means having a common horizontal axis, and in which the support for said discharge chute includes pivot means removably mounted in said pivot mounts, whereby, when in place, said pivot means permit the chute to be inclined, and their removal permits the chute to be moved out of the path of tilt of the cab.

6. A transit concrete mixer as defined in claim 1, in which said discharge chute, when in place and supported by said ring bearing, is positioned at such spacing forward of the cab and at such height above the lateral tilting axis as to permit forward tilt of the cab through an angle of substantially 25° or more, whereby to permit limited access to the engine for routine servicing.

7. A front discharging transit concrete mixer comprising a tiltable cab-around-engine truck chassis of the type having means to permit forward tilt of the cab through an angle of substantially 45° or more about a lower forward transverse tilt axis and having within the cab an engine enclosure and a driver's position at one side thereof, a rotatable mixer barrel mounted on said chassis and having an axis of rotation directed forward and slantingly upward and having a barrel extension therealong projecting forward beyond the cab, said barrel and barrel extension having internal vanes so convoluted as to deliver concrete mix therefrom when rotated in one sense and to retain and continuously agitate it therein when rotated in the opposite sense, the cab roof and rear wall having a channel portion under the barrel extension and over the engine enclosure, whereby to accommodate said barrel extension, said channel portion increasing in depth toward the rear sufficiently to pass said barrel extension when the cab is tilted forward, discharge apparatus at the forward end of said barrel extension supported forwardly of the cab and including a discharge funnel positioned to receive delivered by said barrel extension, together with horizontal ring bearing means positioned about the lower end of said discharge funnel, and a discharge chute the upper end of which is supported rotatably by and beneath the said ring bearing means in position to receive concrete from said discharge funnel, together with support structure for said discharge apparatus, said support structure having as aft structure longitudinal girders extending from said discharge apparatus rearward spacedly above the forward part of the cab and flanking the barrel extension and descending slopingly downward, past the intersections of the cab roof and rear wall outboard of the channel portion, to girder mounts rearward of the cab, the portions of said girders forward of said roof-wall intersections being at such height as to provide clearance for the arcuate swing of said intersections about the tilt axis when the cab is tilted forward, together with means to release portions of the discharge apparatus in the path of tilt of the cab, whereby to permit their removal therefrom.

8. A front discharging transit concrete mixer as defined in claim 7, wherein said support structure further includes forward structure comprising vertical columns outboard of the cab adjacent to its forward end, and structural members extending inward from the upper ends of said columns at such height to clear the cab when tilted forward, there being means to connect said forward structure to the forward ends of said longitudinal girders, the said discharge funnel and horizontal ring bearing means being fixedly mounted to said forward structure at such level as to permit said channeled roof of the cab to pass therebeneath when the cab is tilted forward, and wherein said means to release portions of the discharge apparatus comprises means to release the discharge chute from the ring bearing.

9. A front discharging transit concrete mixer as defined in claim 7, wherein said support structure further includes forward structure comprising vertical columns supported by the chassis outboard of the cab adjacent to its forward end, and structural members extending inward from the upper ends of said columns at such height to clear the cab when tilted forward, and in which the said forward structure fixedly mounts a charging funnel and the said discharge funnel and horizontal ring bearing means, and wherein said means to release portions of the discharge apparatus comprises A. releasable means to connect said forward structure to the forward ends of said longitudinal girders, and B. means at the lower ends of the columns to permit said forward structure and said apparatus mounted thereon to be moved out of their positions relative to the barrel extension and cab, whereby, when said means to connect the forward structure to said girders is released, to permit servicing of said apparatus at ground level as well as unrestricted forward tilt of the cab without removing the discharge chute.

10. A front discharging transit concrete mixer as defined in claim 9, wherein the said means at the lower ends of the columns comprises means to permit forward tilt thereof about a transverse axis.

11. A front discharging transit concrete mixer as defined in claim 9, wherein the said means at the lower ends of the columns comprises vertical socket means into which the column lower ends are removably fitted.

12. A front discharging transit concrete mixer comprising a tiltable cab-around-engine truck chassis of the type having means to permit forward tilt of the cab through an angle of substantially 45° or more about a lower forward transverse tilt axis and having within the cab an engine enclosure and a driver's position at one side thereof, a rotatable mixer barrel mounted on said chassis and having an axis of rotation directed forward and slantingly upward and having a barrel extension therealong projecting forward beyond the cab, said barrel and barrel extension having internal vanes so convoluted as to deliver concrete mix therefrom when rotated in one sense and to retain and continuously agitate it therein when rotated in the opposite sense, the cab roof and rear wall having a channel portion under the barrel extension and over the engine enclosure, whereby to accommodate said barrel extension, said channel portion increasing in depth toward the rear sufficiently to pass said barrel extension when the cab is tilted forward, barrel charging and discharge apparatus at the forward end of said barrel extension supported forwardly of the cab, and support structure for said discharge apparatus, said support structure including forward structure normally mounted erect on the forward lower part of the chassis, and onto the upper part of which said discharge apparatus is mounted, and aft structure extending rearward spacedly above the forward part of the cab and sideward of the barrel extension and descending slopingly downward, past the intersections of the cab roof and rear wall outboard of the channel portion, to mounts rearward of the cab, whereby on tilting the cab said intersections may pass therebeneath, together with means to releasably connect said forward structure to the forward ends of said aft structure, whereby, on release thereof, said discharge apparatus may be moved from its normal erect position for servicing it and to permit unrestricted tilt of the cab.

13. A front discharging transit concrete mixer comprising a cab-around-engine truck chassis of the type having within the cab an engine enclosure and a driver's position at one side thereof, a rotatable mixer barrel mouned on said chassis and having an axis of rotation directed forward and slantingly upward and having a barrel extension therealong projecting forward beyond the cab, said barrel and barrel extension having internal vanes so convoluted as to deliver concrete mix therefrom when rotated in one sense and to retain and continuously agitate it therein when rotated in the opposite sense, the cab roof and rear wall having a channel portion under the barrel extension and over the engine enclosure, whereby to accommodate said barrel extension, said channel portion increasing in depth toward the rear sufficiently to accommodate said barrel extension, barrel charging and discharge apparatus at the forward end of said barrel extension supported forwardly of the cab and including a discharge funnel positioned to receive concrete delivered by said barrel extension, together with horizontal ring bearing means positioned about the lower end of said discharge funnel, and a discharge chute the upper end of which is supported rotatably by and beneath the said ring bearing means in position to receive concrete from said discharge funnel, together with support structure for said discharge apparatus, whereby front discharge of concrete mix is achieved at a minimum height without loss of seating space within the cab.

14. A transit concrete mixer as defined in claim 13, wherein the engine enclosure is offset from center away from the driver's position, and in which the axis of the mixer barrel and barrel extension is similarly offset, and in which the direction of convolution of the vanes for such continued agitation is in such sense as to displace concrete within the mixer to the opposite side of center, whereby such displacement substantially balances the offset of the barrel and barrel extension and permits greater room within the cab at the driver's position.

* * * * *